United States Patent [19]

Cyron et al.

[11] Patent Number: 4,842,954

[45] Date of Patent: Jun. 27, 1989

[54] METAL CATALYST CARRIER BODY, BLANK FOR PRODUCING THE BODY

[75] Inventors: Theodor Cyron, Bergisch Gladbach; Manfred Vierkötter, Neunkirchen-Seel.; Rolf Hetzelberger, Cologne, all of Fed. Rep. of Germany

[73] Assignee: Emitec Gesellschaft für Emissionstechnologie mbH, Lohmar, Fed. Rep. of Germany

[21] Appl. No.: 123,386

[22] Filed: Nov. 20, 1987

[30] Foreign Application Priority Data

Nov. 20, 1986 [DE] Fed. Rep. of Germany ..... 3639597

[51] Int. Cl.[4] ..... B01J 35/04; F01N 3/28

[52] U.S. Cl. ..... 428/593; 428/592; 502/439

[58] Field of Search ..... 428/577, 586, 592, 593; 502/439

[56] References Cited

U.S. PATENT DOCUMENTS

| | | | |
|---|---|---|---|
| 3,086,625 | 4/1963 | Wyatt | 428/592 |
| 3,876,556 | 4/1975 | Laack et al. . | |
| 3,958,626 | 5/1976 | Klein | 428/592 |
| 3,966,646 | 6/1976 | Noakes et al. | 502/439 |
| 4,193,793 | 3/1980 | Cheung | 502/439 |
| 4,205,118 | 5/1980 | Schubert | 428/593 |
| 4,221,843 | 9/1980 | Mundy | 428/592 |
| 4,239,834 | 12/1980 | Cunningham | 428/592 |
| 4,394,422 | 7/1983 | Van Thyne et al. | 428/592 |
| 4,576,800 | 3/1986 | Retallic | 502/439 |
| 4,598,063 | 7/1986 | Retallic | 502/439 |
| 4,713,361 | 12/1987 | Maus | 428/593 |
| 4,719,680 | 1/1988 | Cyron | 428/593 |
| 4,742,038 | 5/1988 | Matsumoto | 502/439 |
| 4,753,918 | 6/1988 | Cyron | 502/439 |

FOREIGN PATENT DOCUMENTS

| | | | |
|---|---|---|---|
| 0186801 | 7/1986 | European Pat. Off. | 502/439 |
| 0223058 | 5/1987 | European Pat. Off. | 502/439 |
| 1097344 | 7/1961 | Fed. Rep. of Germany . | |
| 2247254 | 4/1973 | Fed. Rep. of Germany . | |
| 2452929 | 5/1975 | Fed. Rep. of Germany . | |
| 2856030 | 6/1980 | Fed. Rep. of Germany . | |
| 3515681 | 11/1986 | Fed. Rep. of Germany | 502/439 |
| 3527111 | 1/1987 | Fed. Rep. of Germany | 502/439 |
| 3601011 | 7/1987 | Fed. Rep. of Germany | 502/439 |
| 1421463 | 11/1965 | France . | |
| 2071547 | 4/1987 | Japan | 502/439 |
| 1491198 | 11/1977 | United Kingdom . | |
| 2001547 | 2/1979 | United Kingdom | 502/439 |

*Primary Examiner*—Upendra Roy
*Assistant Examiner*—David W. Schumaker
*Attorney, Agent, or Firm*—Herbert L. Lerner; Laurence A. Greenberg

[57] ABSTRACT

A blank for the production of a catalyst carrier body includes spirally-wound alternating layers of smooth and corrugated metal sheets. At least one of said corrugated sheets forms an innermost layer defining a coil-free central zone surrounded by said innermost layer. A jacket is added around the blank to form a catalyst carrier body. The sheets are wound on a toothed roller.

7 Claims, 1 Drawing Sheet

METAL CATALYST CARRIER BODY, BLANK FOR PRODUCING THE BODY

The invention relates to a catalyst carrier body, a blank for the production of the body from spirally wound alternating layers of smooth and corrugated metal sheets having a coil-free central zone, and a method for producing the same.

In so-called starting catalysts, in other words catalysts that are installed close to the engine and therefore reach the operating temperature thereof very quickly after starting the engine, it is known to use metal carrier bodies made of of spirally-wound alternating layers of smooth and corrugated metal sheets. In order to keep the pressure loss of the catalyst carrier bodies low, the central zone is sometimes kept as free of coils as possible, so that a portion of the exhaust gases can flow unhindered therethrough. The reason that this is acceptable is because starting catalysts are generally operated in combination with other means for reducing the emission of toxic substances.

Heretofore, such catalyst carrier bodies were wound onto a cylindrical mandrel, for instance, and the first two layers could be fixed in the mandrel, such as by means of a slit. In a typical shape produced by such a method, the ends of the inner layers still protrude randomly into the central zone after the mandrel is removed. These ends interfere with the flow, without being able to meaningfully contribute to the catalytic conversion.

Furthermore, when winding is performed onto a cylindrical mandrel, a smooth metal sheet is typically used as the innermost layer, which makes it difficult to grasp the end of the sheet during mass production, considering the fast cycle times involved.

German Published, Non-Prosecuted Application DE-OS No. 28 56 030, corresponding to U.S. Pats. Nos. 4,282,186; 4,400,860; and 4,519,120, discloses a blank for producing a flattened catalyst carrier body, which is also wound onto a cylindrical mandrel. With this type of construction and the associated production process, the same problems arise at the beginning of the winding process as with the aforementioned starting catalysts.

It is accordingly an object of the invention to provide a metal catalyst carrier body or a blank for the eventual production thereof as well as a method for the production thereof, which overcome the hereinafore-mentioned disadvantages of the heretofore-known methods and devices of this general type and which has a coil-free central zone in which the above-discussed problems do not arise.

With the foregoing and other objects in view there is provided, in accordance with the invention, a blank for the production of a catalyst carrier body, comprising spirally-wound alternating layers of smooth and corrugated metal sheets, at least one of said corrugated sheets forming an innermost layer defining a coil-free central zone surrounded by said innermost layer. The catalyst carrier body itself is produced by adding a jacket around the sheets.

In accordance with another feature of the invention, the innermost layer is formed of a plurality of said corrugated sheets.

The corrugation of the innermost layer neither interferes with the central component of the flow nor creates problems in the event that the catalyst carrier body is later to be compressed into a flat shape.

In accordance with a further feature of the invention, the smooth and corrugated sheets have two end surfaces, and there are provided first brazed connections at one of said end surfaces joining said layers to one another and to said jacket, and second brazed connections at the other of said end surfaces brazing substantially the innermost two to ten sheets to one another.

In accordance with an added feature of the invention, the first brazed connections are disposed at the circumference of the catalyst carrier body, and said second brazed connections are disposed substantially at the center of the catalyst carrier body.

In this way, there is no hindrance to the expansion and increase in size of the catalyst carrier body in the jacket, yet the innermost layers cannot flutter or become unstable, because they are brazed on both ends.

With the objects of the invention in view, there is also provided a method for producing a blank for the production of a catalyst carrier body, which comprises initially winding a corrugated metal sheet and subsequently winding a smooth metal sheet spirally onto a toothed roller having teeth substantially corresponding to corrugations of the corrugated metal sheet. In order to produce the body itself, a jacket is placed around the wound corrugated and smooth metal sheets.

Such a method of production offers considerable advantages, because the innermost layers can be wound onto a toothed roller having teeth which correspond approximately to the corrugation of the corrugated metal sheets, instead of being wound onto a cylindrical mandrel. If a corrugated sheet metal strip is delivered to a rotating toothed roller of this kind, the roller will grasp the corrugated sheet metal strip in virtually any position and it will impose the traction required for the winding process. In this way, the threading of the ends of the smooth or corrugated sheet metal strips into a slit mandrel, for instance, can be dispensed with entirely, so that the production cycle times can be minimized. In any event, the use of a toothed roller instead of a cylindrical mandrel has no disadvantages, so that all of the other production steps can remain unchanged. The toothed roller is withdrawn after the winding process has been ended and the resultant catalyst carrier body or blank can be subjected to the further conventional production steps, such as enclosing it in a metal jacket, applying bracing material to it, brazing it, coating it, and so forth.

Should it be desirable for reasons of stability, two or more layers of the corrugated sheet metal strip can also be wound onto the toothed roller first, before the actual honeycomb structure is wound on by adding a smooth sheet-metal strip.

The use of a toothed roller as the mandrel assures that a second or third layer of a corrugated sheet metal strip will also become virtually form-lockingly wrapped against the first sheet-metal layer, as long as no smooth sheet-metal strip is added as an intervening layer. A form-locking connection is one which connects two elements together due to the shape of the elements themselves, as opposed to a force-locking connection which locks the elements together by force external to the elements. The result of this connection is a stable, multiply corrugated innermost layer, which separates the coil-free central zone from the actual honeycomb body. The end of the innermost layer can be additionally fixed by joining techniques, such as brazing, soldering, welding or gluing.

Other features which are considered as characteristic for the invention are set forth in the appended claims.

Although the invention is illustrated and described herein as embodied in a metal catalyst carrier body, a blank for producing the body and a method for the production thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
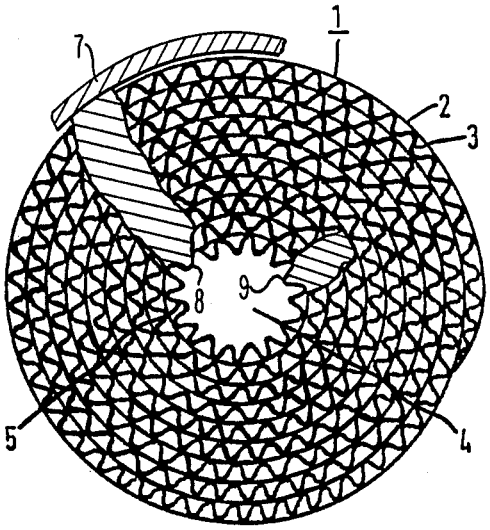
FIG. 1 is a diagrammatic, cross-sectional view of a first embodiment of the catalyst carrier body according to the invention with a single-layer corrugated sheet metal strip in the central zone.

Referring now to the figures of the drawings in detail and first, particularly, to FIG. 1 thereof, there is seen a catalyst carrier body 1 spirally wound from one smooth sheet metal strip 2 and one corrugated sheet metal strip 3, with a coil-free central zone 4 which is left empty. The coil-free central zone 4 is surrounded by an innermost corrugated sheet metal layer 5.

Figure 2:
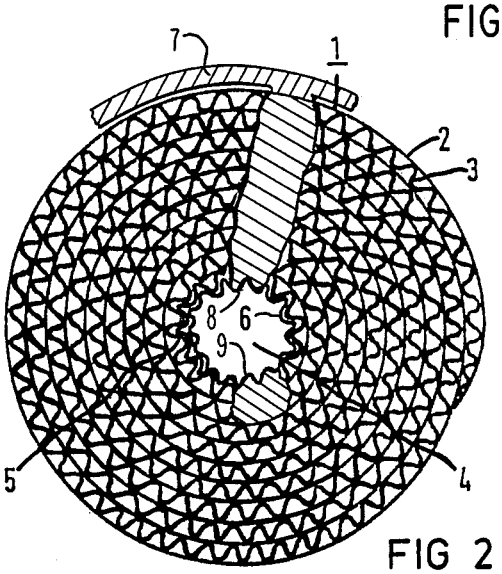
FIG. 2 is a view similar to FIG. 1 showing a second embodiment of the invention with a multi-layer corrugated sheet metal strip in the central zone.

FIG. 2 shows a catalyst carrier body in which elements which are identical with those in the FIG. 1 embodiment have been given the same reference numerals. However, in the FIG. 2 embodiment, an innermost corrugated sheet metal layer 6 is formed of a plurality of individual corrugated sheets 3. Depending on the stability and quality needed for the boundary surrounding the central zone, two or more corrugated layers are stacked one on top of the other in a form-locking manner, before the formation of the actual honeycomb body begins by the addition of the smooth sheet metal strip.

After the sheets 2 and 3 are wound as described above, an intermediate product in the form of a blank is formed. A jacket, shell or tube 7 is placed around the sheets 2 and 3 in order to form the completed body.

After winding, first brazed connections 8 are provided at one of the end surfaces of the body in order to join the layers to one another and to the jacket 7, and second brazed connections 9 are provided at the other of the end surfaces for brazing substantially the innermost two to ten sheets to one another. The connections have been broken away to show the sheets, but they actually form complete ring or washer-shaped regions. The connections 8 form a wide ring from the zone 4 to the jacket 7 while the connections 9 form a much more narrow ring. The first connections 8 and the second connections 9 are shown at the same end of the body in the drawing for clarity. However, they are actually at opposite ends of the body.

Figure 3:
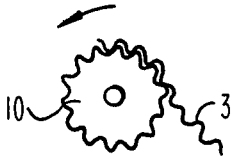
FIG. 3 is a side-elevational view of a toothed roller on which the body is wound.

FIG. 3 shows a toothed roller 10 on which the corrugated sheet 3 is being wound at the beginning of the winding process. The teeth of the roller 10 correspond in size to the corrugations of the sheet 3. After one layer of the corrugated sheet 3 is wound, the winding of the smooth sheet 2 may be begun in order to produce a blank as shown in Fig. 1. A plurality of corrugated sheets are wound before the first smooth sheet 2 is added in order to produce a blank as shown in FIG. 2. After the process is completed, the roller 10 is simply slipped out.

Since the metal sheets which are used are very thin, a further advantage is attained with the above-described method of production. This advantage resides in the fact that it is not particularly critical when the addition of the smooth sheet metal strip is begun during the winding process.

Although differences of one or two turns do increase the number of the corrugated sheet metal layers that are initially wound on top of one another, the total diameter of the body varies only by fractions of millimeters, which is not of particular significance.

The invention therefore greatly facilitates the beginning of the winding of a catalyst carrier body having a coil-free central zone, because sheets need not be threaded into a slit and possible sources of error can be reduced considerably. In this way, certain time periods during the production cycle process can be shortened. Nevertheless, there are no differences or even disadvantages as compared with the prior art in the remainder of the procedure.

We claim:

1. Blank for the production of a catalyst carrier body, comprising spirally-wound alternating layers of smooth and corrugated metal sheets, at least one of said corrugated sheets forming an innermost layer defining a coil-free central zone surrounded by said innermost layer.

2. Blank according to claim 1, wherein said innermost layer is formed of a plurality of said corrugated sheets.

3. Catalyst carrier body, comprising spirally-wound alternating layers of smooth and corrugated metal sheets, at least one of said corrugated sheets forming an innermost layer defining a coil-free central zone surrounded by said innermost layer, and a jacket surrounding said smooth and corrugated sheets.

4. Catalyst carrier body according to claim 3, wherein said innermost layer is formed of a plurality of said corrugated sheets.

5. Catalyst carrier body according to claim 3, wherein said smooth and corrugated sheets have two end surfaces, and including first brazed connections at one of said end surfaces joining said layers to one another and to said jacket, and second brazed connections at the other of said end surfaces brazing substantially the innermost two to ten sheets to one another.

6. Catalyst carrier body according to claim 4, wherein said smooth and corrugated sheets have two end surfaces, and including first brazed connections at one of said end surfaces joining said layers to one another and to said jacket, and second brazed connections at the other of said end surfaces brazing substantially the innermost two to ten sheets to one another.

7. Catalyst carrier body according to claim 4, wherein said first brazed connections are disposed at the circumference of the catalyst carrier body, and said second brazed connections are disposed substantially at the center of the catalyst carrier body.

* * * * *